US006910534B2

(12) United States Patent
Linyaev et al.

(10) Patent No.: US 6,910,534 B2
(45) Date of Patent: Jun. 28, 2005

(54) APPARATUS FOR ATTACHING A SENSOR TO A TUBING STRING

(75) Inventors: Eugene Joseph Linyaev, Houston, TX (US); Patrick Dennis Chesnutt, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/167,103

(22) Filed: Jun. 11, 2002

(65) Prior Publication Data

US 2003/0226662 A1 Dec. 11, 2003

(51) Int. Cl.[7] ..... E21B 47/01; E21B 49/00; E21B 17/10

(52) U.S. Cl. ..... 166/250.11; 166/66; 166/241.7; 175/325.6; 73/152.17

(58) Field of Search ..... 166/250.01, 250.11, 166/381, 385, 65.1, 66, 117.5, 241.1, 241.2, 241.6, 241.7, 242.2, 242.6; 175/325.1, 325.5, 325.6; 73/152.01, 152.02, 152.17, 152.18, 152.43, 152.54

(56) References Cited

U.S. PATENT DOCUMENTS

| | | | | | |
|---|---|---|---|---|---|
| 4,004,326 | A | * | 1/1977 | Beavers | 166/241.6 |
| 4,337,969 | A | * | 7/1982 | Escaron et al. | 285/24 |
| 4,422,504 | A | * | 12/1983 | Moore | 166/241.7 |
| 4,478,278 | A | * | 10/1984 | Klein | 166/105 |
| 4,603,737 | A | * | 8/1986 | Spikes | 166/241.7 |
| 4,662,442 | A | * | 5/1987 | Debreuille | 166/250.01 |
| 4,775,009 | A | * | 10/1988 | Wittrisch et al. | 166/250.11 |
| 5,017,778 | A | * | 5/1991 | Wraight | 250/254 |
| 5,148,864 | A | * | 9/1992 | Willis et al. | 166/65.1 |
| 5,181,565 | A | | 1/1993 | Czernichow | 166/66 |
| 5,235,285 | A | * | 8/1993 | Clark et al. | 324/342 |
| 5,243,562 | A | | 9/1993 | Laurent et al. | 367/25 |
| 5,339,036 | A | * | 8/1994 | Clark et al. | 324/338 |
| 5,379,836 | A | * | 1/1995 | Jordan | 166/241.6 |
| 5,565,624 | A | * | 10/1996 | Deboaisne et al. | 73/152.02 |
| 5,801,642 | A | * | 9/1998 | Meynier | 340/856.1 |
| 5,941,307 | A | * | 8/1999 | Tubel | 166/313 |
| 5,947,199 | A | | 9/1999 | Havig | 166/250.01 |
| 5,962,819 | A | | 10/1999 | Paulsson | 181/102 |
| 6,131,658 | A | | 10/2000 | Minear | 166/250.01 |
| 6,138,752 | A | * | 10/2000 | Bass et al. | 166/250.01 |
| 6,173,804 | B1 | * | 1/2001 | Meynier | 181/102 |
| 6,179,066 | B1 | * | 1/2001 | Nasr et al. | 175/45 |
| 6,230,557 | B1 | * | 5/2001 | Ciglenec et al. | 73/152.01 |
| 6,250,405 | B1 | * | 6/2001 | Moore et al. | 175/325.1 |
| 6,263,726 | B1 | * | 7/2001 | Hubbell et al. | 73/73 |
| 6,283,205 | B1 | * | 9/2001 | Cannon | 166/241.1 |
| 6,289,985 | B1 | | 9/2001 | Meynier | 166/60 |
| 6,446,723 | B1 | * | 9/2002 | Ramos et al. | 166/285 |
| 6,523,609 | B1 | * | 2/2003 | Miszewski | 166/66 |
| 6,595,284 | B2 | * | 7/2003 | Davis | 166/241.4 |
| 2002/0062958 | A1 | * | 5/2002 | Diener et al. | 166/243 |

FOREIGN PATENT DOCUMENTS

| | | | |
|---|---|---|---|
| GB | 2 345 709 | 7/2000 | E21B/47/00 |

* cited by examiner

*Primary Examiner*—David Bagnell
*Assistant Examiner*—Jennifer H Gay
(74) *Attorney, Agent, or Firm*—Shannon W. Bates

(57) ABSTRACT

A method and apparatus, for deploying a sensor attached to tubing in a highly deviated or horizontal wellbore, that are characterized by a stationary attachment system that securely fixes a sensor to a tubing string such that the sensor is coupled to the casing regardless of the orientation of the tubing within the wellbore. One preferred embodiment includes a clamp assembly that encloses the sensor and clamps around the cubing string. The clamp assembly further includes a plurality of contact members that provide stable contact points between the well casing and the clamp assembly. The embodiments of the present invention act to maintain the sensor in a stable coupling with the casing without any actuation required for installation.

19 Claims, 3 Drawing Sheets

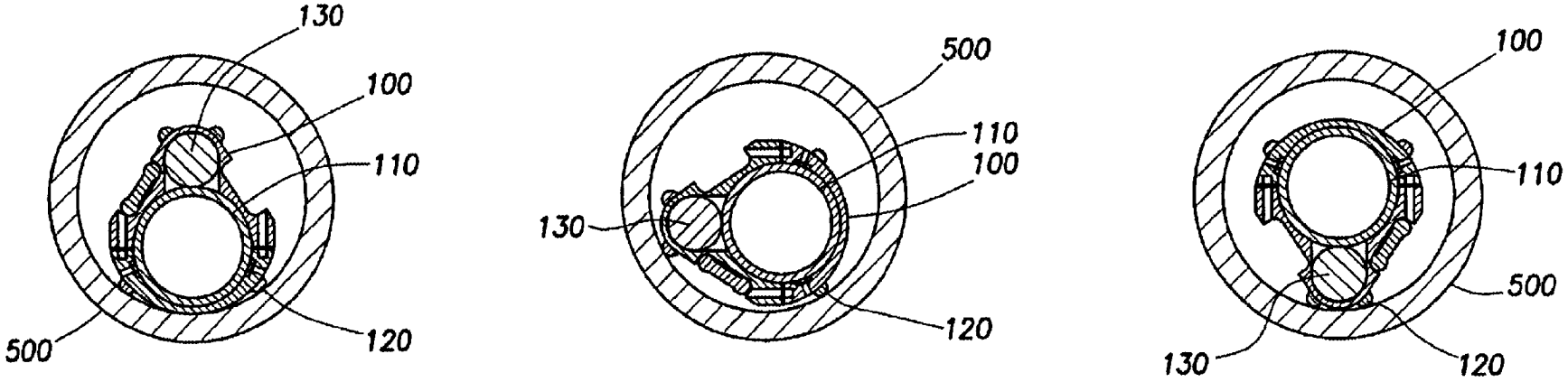
FIG.3a
FIG.3b
FIG.3c
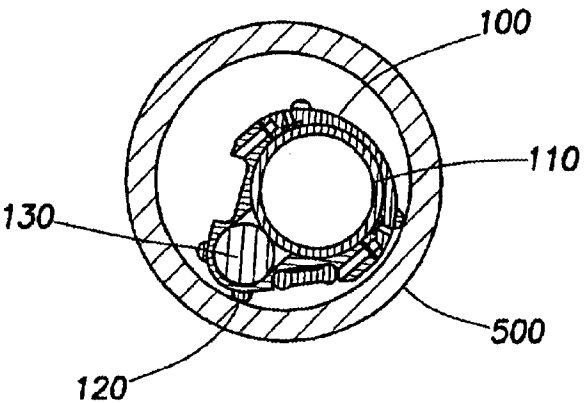
FIG.3d
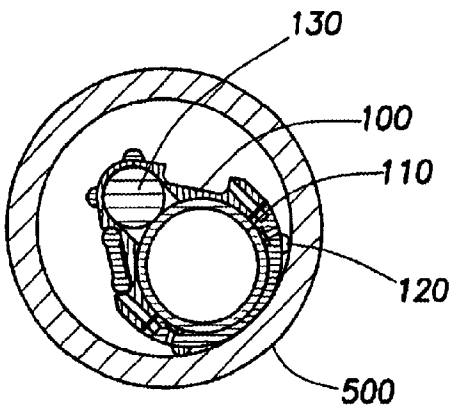
FIG.3e

APPARATUS FOR ATTACHING A SENSOR TO A TUBING STRING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates generally to methods and apparatus for attaching a sensor to a tubing string for deployment within a wellbore. More specifically, the present invention relates to methods and apparatus for attaching a sensor to a tubing string for deployment within a highly deviated wellbore.

During the production of hydrocarbons from an underground reservoir or formation, it is important to determine the development and behavior of the reservoir and to foresee changes which will affect the reservoir. Methods and apparatus for determining and measuring downhole parameters for forecasting the behavior of the reservoir are well known in the art.

A standard method and apparatus includes placing one or more sensors downhole adjacent the reservoir and recording seismic signals generated from a source often located at the surface. Hydrophones, geophones, and accelerometers are three types of sensors used for recording such seismic signals. Hydrophones respond to pressure changes in a fluid excited by seismic waves, and consequently must be in contact with the fluid to function. Seismic waves are waves of elastic energy, approximately in the range of 1 to 100 Hz, having both a compressional and a shear component, where the compressional component, or P-wave, oscillates in a direction parallel to propagation of the wave, and the shear component, or S-wave, oscillates in a direction perpendicular to the propagation of the wave.

Hydrophones are non-directional and respond only to the compressional component of the seismic wave. They can be used to indirectly measure the shear wave component when the shear component is converted to a compressional wave (e.g. at formation interfaces or at the wellbore-formation interface). Geophones measure both compressional and shear waves directly They include particle velocity detectors and typically provide three-component velocity measurement. Accelerometers also directly measure both compressional and shear waves, but instead of detecting particle velocities, accelerometers detect accelerations, and hence have higher sensitivities at higher frequencies. Accelerometers are also available having three-component acceleration measurements. Both geophones and accelerometers can be used to determine the direction of arrival of the transmitted waves.

Other sensors are available that enable various parameters to be measured, especially acoustic noise, natural radioactivity, temperature, pressure, etc. The sensors may be positioned inside the production tubing for carrying out localized measurements of the nearby annulus or for monitoring fluid flowing through the production tubing. While the location within the wellbore of some of these sensors is not critical, in the case of geophones and accelerometers, the sensors must be mechanically coupled to the formation in order to conduct the desired measurement.

One method of coupling a sensor to the formation is by providing the wireline sonde with a mechanical arm which can be extended against the wall of the casing. The arm may be extended by mechanical means, fluid pressure, or electrical actuation. When extended, the arm presses the sensor against the opposite wall of the casing with a force sufficient to prevent relative motion of the sensor with respect to the casing. As a rule of thumb, the force applied by the arm should be at least five times the weight of the sensor, and it is not uncommon for sensors to weigh 30 lbs. or more.

Another mechanism for coupling a sensor to a formation involves the use of springs to force the sensor against the wall of the casing. The sensor is maintained in a retracted position while the tubing string is run into the wellbore. When the tubing string has reached its deployment location, the springs are released and force the sensor against the casing. As in those designs employing arms, the springs are designed to provide a certain force to push the sensor onto the casing. When operating in highly deviated well sections, including near horizontal and horizontal sections, both spring and arm systems have faced challenges. In contrast to a normal vertical wellbore, where the string is likely to be somewhat centered, in these highly deviated sections the tubing string is likely to rest against the casing with some or all of the weight of the string bearing against the casing wall.

Although most spring and arm systems are designed to actuate with a force greater than the weight of the sensor, they may not have enough force to push the string away from the casing, when the sensor is between the casing and the tubing, or sufficient reach to push the sensor against the far wall of the casing, when the tubing is directly against the casing. If the system fails to fully actuate, the sensor may not be maintained in the desired, stable relationship with the wellbore, making data acquisition conditions less than ideal.

Thus, there remains a need in the art for methods and apparatus to deploy sensors into highly deviated sections of a wellbore. Therefore, the embodiments of the present invention are directed to methods and apparatus, for attaching a sensor to a tubing string for deployment in a highly deviated wellbore section, that seek to overcome these and other limitations of the prior art.

SUMMARY OF THE PREFERRED EMBODIMENTS

Accordingly, there is provided herein methods and apparatus for attaching a sensor to a tubing string for installation into a highly deviated wellbore. The preferred embodiments of the present invention are characterized by an apparatus for securely affixing a sensor to a tubing string, wherein the apparatus also provides a sufficient coupling to the casing of the wellbore. The embodiments of the present invention act to provide stable, reliable coupling between a sensor and the casing of a highly deviated wellbore. In this context a stable, reliable coupling is achieved when a sensor is maintained in a position to the wellbore where no relative motion occurs between the sensor and the wellbore during data acquisition.

In preferred embodiments, the invention includes at least the following embodiments. One embodiment of an apparatus for collecting data from a wellbore includes a sensor, a tubing string, and a connector that fixes the sensor to the tubing so that there is no relative motion between the sensor and the tubing. One such connector includes a first clamping portion and a second clamping portion adapted to form a clamp assembly around a tubing string. The first clamping portion encloses the sensor and attaches around the tubing string to the second clamping portion. The outside surface of both first and second portions may have a plurality of contact members connected thereto for interfacing with the wellbore.

The first clamping portion also provides access to connect a sensor to adjacent sensors in a sensor array. In alternative embodiments, either the first or second portion inside diameter may have one or more gripping dogs to ensure the attachment to the tubing string. The clamp assembly may also have one or more bypass grooves to allow for tubing and/or cabling from adjacent instrumentation packages to bypass the clamping assembly.

The present invention may also be embodied as a method for disposing a sensor in a highly deviated or horizontal wellbore. A sensor is placed inside a first clamping portion that is combined with a second clamping portion and compressed against a tubing string using a predetermined force. Once the predetermined force is reached, attachment members are installed attaching the first portion to the second portion. Sensor and clamping assembly is then lowered into the wellbore where, in a highly deviated or horizontal section, the tubing and clamp assembly will come to rest on one side of the casing.

When disposed in a highly deviated or horizontal wellbore, the mass of the tubing string will force the clamp assembly to the lowermost portion of the casing. The clamp assembly will come to rest on the inside of the casing, preferably contacting in at least two points, and a coupling will be formed between the sensor and the casing across the clamp assembly and the contact members.

Thus, the present invention comprises a combination of features and advantages that enable sensors to be reliably deployed in a highly deviated or horizontal wellbore. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a more detailed understanding of the preferred embodiments, reference is made to the accompanying Figures, wherein:

FIGS. 3*a*–3*e* are partial sectional views of a clamp assemblies disposed within a wellbore.

DETAILED DESCRIPTION OF THE PREFERRED EMBODIMENTS

Figure 1:
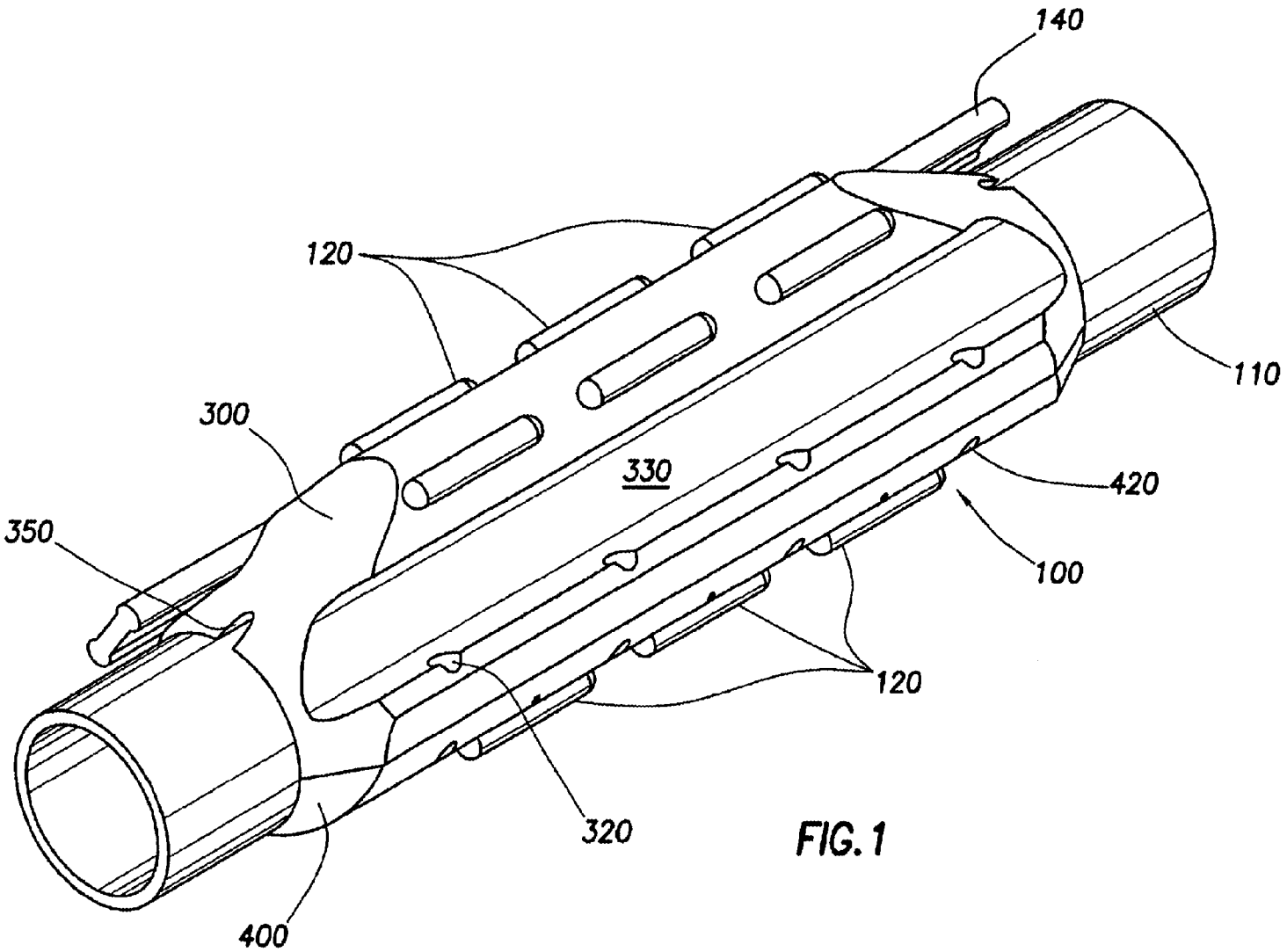
FIG. 1 is a perspective view of a clamp assembly.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

The preferred embodiments of the present invention relate to methods and apparatus for attaching a sensor to a tubing string for deployment in a highly deviated section of a cased wellbore such that the sensor is maintained in a stable, reliable relationship with the well casing. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Referring now to FIG. 1, sensor clamp assembly 100 can be seen installed on tubing string 110. Assembly 100 includes a first clamping portion 300 and a second clamping portion 400 disposed around tubing 110. Assembly 100 also includes a plurality of contact members 120 which are disposed on the outside surface of both first portion 300 and second portion 400. First clamping portion 300 is connected to second clamping portion 400 by way of a plurality of attachment members (not shown), such as screws or bolts, disposed within a plurality of attachment holes 320, 420 in each portion, best shown in FIG. 2. First portion 300 also preferably has a bypass groove 330 in which may be disposed a cable 140. Each end of first portion 300 also preferably has an access hole 350 to accommodate interconnection between adjacent sensor assemblies.

Figure 2:
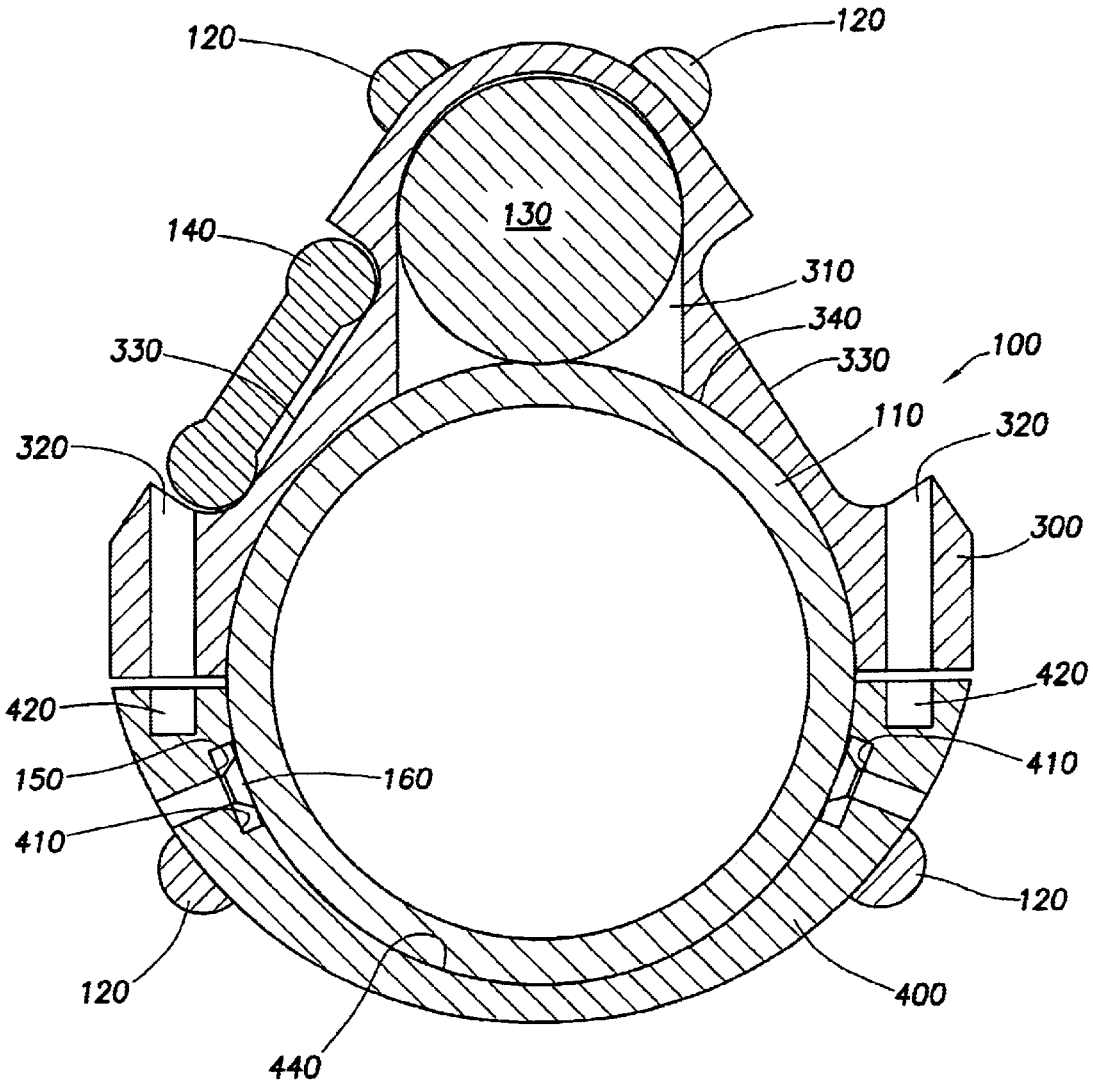
FIG. 2 is a sectional view of the clamping assembly of FIG. 1.

Referring now to FIG. 2, assembly 100, as installed on tubing 110, is shown in cross-section. First clamping portion 300 includes sensor cavity 310, attachment holes 320, bypass grooves 330, and inside surface 340. Second clamping portion 400 includes recesses 410, attachment holes 420, and inside surface 440. Assembly 100 further comprises contact members 120, sensor 130, cable 140, dogs 150, and dog attachment members 160.

First clamping portion 300 has an inside surface 340 that is curved so as to conform to the outer surface of tubing 110. Portion 300 also includes sensor cavity 310 which is adapted to receive a sensor 130 and maintain sensor 130 in stable contact with tubing 110. Either end of cavity 310 has access holes 350 (as shown in FIG. 1) that allow sensor 130 to be connected to adjacent sensors in an array.

The outer surface of first portion 300 has one or more lengthwise bypass grooves 330 that are sized to accommodate cable 140 as it extends past assembly 100. Grooves 330 are preferably adapted to receive a flat-pack, or other low profile, cable but may be adapted to receive any cable or tubing that may bypass assembly 100. First portion 300 also has a plurality of contact members 120 attached to the outer surface. Contact members are preferably constructed of hardened metallic materials welded, or otherwise attached, in place. First portion 300 also includes a plurality of attachment holes 320 corresponding to attachment holes 420 in second portion 400.

Second clamping portion 400 has an inside surface 440 that is curved so as to conform to the outer surface of tubing 110. Inside surface 440 may have one or more recesses 410 adapted to receive dogs 150 that attach to lower portion 400 by way of dog attachment members 160. Alternatively dogs 150 may be welded or brazed to inside surface 440. Dogs 150 are preferably hardened metal inserts having a raised profile so as to prevent movement of second portion 400 relative to tubing 110. Dogs 150 may have a rectangular, circular, or other shape as required. Dogs 150 may also be constructed integral to second portion 400. Second portion 400 also has a plurality of contact members 120 attached to the outer surface.

First and second clamp portions 300, 400 are preferably constructed from a material similar to that used to construct the casing and tubing used in the well. For instance, in a well using standard carbon steel pipe, portions 300, 400 may be constructed from a cast steel material. The use of a similar material simplifies the attachment of contact members 120 and also provides for improved data gathering by minimizing the signal loss as a signal travels across different components. In a well having a composite casing or using composite tubing, upper and lower portions 300, 400 may be constructed from a composite or other non-metallic material.

During installation, first clamping portion 300, containing sensor 130, and second clamping portion 400, including dogs 150, are placed around tubing 110. Portions 300, 400 are compressed against tubing 110 and each other and attachment members (not shown) are installed through attachment holes 320 and 420. The compressive force necessary to securely attach portions 300 and 400 to each other and to tubing 110 may be provided by a hydraulic press, or other type of preloading device, so as to minimize the size of attachment members required. Sensor 130 and dogs 150 bear against tubing 110 to prevent any relative motion between tubing 110 and clamp assembly 100. Once first portion 300 is securely attached to second portion 400 on tubing 110, assembly 100 is ready for lowering into a wellbore.

Sensor 130 is normally a single sensor component of a sensor array. A sensor array may contain five sensors 130 connected in series on either side of a central processing unit. Individual sensors 130 are normally connected to adjacent sensors and then central unit by small tubing or cable, therefore the relative position of sensors 130 must be maintained. Access holes 350 are provided to allow access to sensor 130 as it is installed in clamp assembly 100.

Referring now to FIGS. 3*a*–3*e*, clamp assembly 100 is shown disposed within casing 500 in a highly deviated or horizontal wellbore. As can be seen in FIGS. 3*a*–3*e*, the mass of tubing 110 forces assembly 100 against the lower portion of casing 500. Regardless of the orientation of tubing 110, clamp assembly 100 comes to rest, preferably on contact members 120, against the inside of casing 500. Therefore, sensor 130 is set in a stable, reliable relationship with casing 500. The mass of tubing 110 maintains the position of assembly 100 within casing 500 so that sensor 130 can detect signals from the surrounding formation.

Therefore, the embodiments of the present invention provide a sensor assembly that creates a stable, reliable connection between sensor 130, tubing 110, and the well casing 500. By utilizing tubing 110 and attachment assembly 100, a simple, robust arrangement for disposing a sensor is provided in a highly deviated or horizontal wellbore. One preferred clamping assembly 100 is described but any assembly that is capable of maintaining a secure connection can be used.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. An apparatus for gathering data from within cased wellbore comprising:

a tubing string disposed within the cased wellbore;

a sensor;

a connector affixed to said tubing and adapted to receive said sensor, wherein relative motion between said sensor and said tubing string is prohibited and said sensor is stably and reliably connected to the wellbore regardless of the orientation of the tubing string.

2. The apparatus of claim 1 wherein said sensor is enclosed within said connector.

3. The apparatus of claim 1 wherein said connector further comprises a first portion and a second portion that form a clamping arrangement around said tubing string.

4. The apparatus of claim 1 wherein said connector further comprises a plurality of contact members that interface between the connector and the wellbore.

5. The apparatus of claim 3 wherein the clamping arrangement maintains a direct contact between said tubing string and said sensor.

6. The apparatus of claim 3 wherein said connector further comprises a plurality of dog members that interface between the connector and the tubing string.

7. The apparatus of claim 1 wherein said connector provides bypass regions for allowing cable or tubing to bypass the connector.

8. The apparatus of claim 1 wherein said connector provides access for connecting said sensor to adjacent sensors in a sensor array.

9. A device for attaching a sensor to a tubing string comprising:

a first portion having a cavity configured to hold the sensor and maintain the sensor in stable contact with the tubing string; and a second portion adapted to attach to said first portion, wherein said first portion and said second portion prohibit relative motion between the sensor and the tubing string.

10. The device of claim 9 further comprising a plurality of attachment members for attaching said first portion to said second portion.

11. The device of claim 9 wherein said first portion comprises:

a curved inner surface including the cavity;

an outer surface; and a plurality of contact members connected to said outer surface.

12. The device of claim 11 wherein said first portion further comprises a bypass groove on said outer surface.

13. The device of claim 9 wherein said second portion further comprises:

an inner curved surface having a plurality of dogs disposed thereon;

an outer surface; and a plurality of contact members connected to said outer surface.

14. A method for deploying a sensor in a deviated wellbore comprising:

attaching the sensor to a tubing string such that the sensor can not move relative to the tubing string; and lowering the tubing string into the deviated wellbore such that the tubing string bears against one side of the wellbore such that the sensor is thereby maintained in a stable, operably connected relationship with the tubing string and the wellbore regardless of the orientation of the tubing string.

15. The method of claim 14 wherein attaching the sensor to a tubing string comprises:

disposing the sensor within a clamping arrangement;

compressing the clamping arrangement to the tubing string; and installing a plurality of attachment members to maintain the clamping arrangement in a compressed position.

16. A method for gathering data from a formation, the method comprising:

attaching one or more sensors to a tubing string with a clamping device;

disposing the tubing string in a deviated, cased wellbore;

allowing the tubing string to rest on one side of the cased wellbore, wherein the one or more sensors are not in direct contact with the casing; and using the one or more sensors to receive signals traveling from the formation through the casing.

17. The method of claim 16 wherein the clamping device comprises:

a first portion having an inner surface conforming to the tubing string and forming a cavity between the inner surface and the tubing string, wherein a sensor is disposed within the cavity;

a second portion attached to said first portion.

18. The method of claim 16 wherein gravitational forces cause the tubing string to rest on one side of the cased wellbore.

19. The method of claim 16 wherein the signals received by the one or more sensors travel through the clamping device and/or the tubing string.

* * * * *

UNITED STATES PATENT AND TRADEMARK OFFICE

CERTIFICATE OF CORRECTION

PATENT NO. : 6,910,534 B2
DATED : June 28, 2005
INVENTOR(S) : Eugene Joseph Linyaev et al.

It is certified that error appears in the above-identified patent and that said Letters Patent is hereby corrected as shown below:

Title page,
Item [57], ABSTRACT,
Line 8, replace “cubing” with -- tubing --.

Signed and Sealed this

Thirtieth Day of August, 2005

JON W. DUDAS
*Director of the United States Patent and Trademark Office*